US007562550B2

(12) United States Patent
Steains

(10) Patent No.: US 7,562,550 B2
(45) Date of Patent: Jul. 21, 2009

(54) CABLE BULBING APPARATUS AND METHOD FOR FORMING BULBS IN A CABLE BOLT

(75) Inventor: Anthony Paul Steains, Marian (AU)

(73) Assignee: Jennmar Corporation, Pittsburgh, PA (US)

( * ) Notice: Subject to any disclaimer, the term of this patent is extended or adjusted under 35 U.S.C. 154(b) by 127 days.

(21) Appl. No.: 11/355,607

(22) Filed: Feb. 16, 2006

(65) Prior Publication Data

US 2006/0180230 A1 Aug. 17, 2006

(30) Foreign Application Priority Data

Feb. 17, 2005 (AU) ..... 2005200714

(51) Int. Cl.
*B21D 11/02* (2006.01)
*B21F 1/00* (2006.01)

(52) U.S. Cl. ..... 72/302; 140/105

(58) Field of Classification Search ..... 140/105; 72/302

See application file for complete search history.

(56) References Cited

U.S. PATENT DOCUMENTS

| | | | | |
|---|---|---|---|---|
| 5,344,256 | A * | 9/1994 | Hedrick | 405/259.1 |
| 6,820,657 | B1 * | 11/2004 | Hedrick | 140/105 |
| 2006/0054748 | A1 | 3/2006 | Rataj et al. | |

FOREIGN PATENT DOCUMENTS

| | | | |
|---|---|---|---|
| AU | 658972 | | 12/1993 |
| AU | 723113 | | 8/1998 |
| AU | 199853034 | A1 | 8/1998 |
| AU | 200027804 | | 10/2000 |
| AU | 770594 | | 4/2001 |
| WO | WO 90/05811 | A1 | 5/1990 |

* cited by examiner

*Primary Examiner*—Dana Ross
*Assistant Examiner*—Teresa Bonk
(74) *Attorney, Agent, or Firm*—The Webb Law Firm

(57) ABSTRACT

A cable bulbing apparatus having a frame (1) and securing means (3) for holding at least a portion of a cable bolt (4) with respect to the frame (1). The apparatus also includes a bulbing assembly (5) which is releasably engagable with the cable bolt (4). The assembly (5) is movable relative to the frame (1) to enable one or more bulbs to be formed along the cable bolt length.

23 Claims, 2 Drawing Sheets

CABLE BULBING APPARATUS AND METHOD FOR FORMING BULBS IN A CABLE BOLT

FIELD OF THE INVENTION

The present invention relates to cable bulbing apparatus and a method of forming bulbs in a cable bolt. The invention has been developed primarily for forming bulbs in rock anchor cable bolts and will be described herein with reference to that application. However, it should be understood that the invention is not limited to that particular field of use and may be suitable for other applications.

BACKGROUND OF THE INVENTION

Any discussion of the prior art throughout the specification should in no way be considered as an admission that such prior art is widely known or forms part of common general knowledge in the field.

Known apparatus for forming bulbs in cable bolts include those described in Australian Patent Nos. 723113 ('113), 640906 ('906) and 770594 ('594).

'113 describes an apparatus which includes two clamp means, one of the clamp means including a one way clamp and a displacement means for displacing the clamping means towards one another to form the bulb.

By comparison, '906 describes an apparatus including a pair of clamp means with each clamp including a pair of plates for clamping a cable. The apparatus also includes a clamp displacement means arranged to displace the clamp means towards one another to form a bulb in a cable and a cable displacement means for displacing the cable longitudinally after a bulb has been formed.

Alternatively, '594 describes an apparatus and method for manufacturing a multi-strand rock bolt including feed means for supplying a multi-strand cable from a rotatable supply reel, a means for forming the cable with bulbs at spaced intervals and a means for determining the position of the cable to stop operation of the feed means to enable a further bulb to be formed.

All three inventions described in the specifications above include some form of cable bulbing assembly which remains in a fixed location. If multiple bulbs are required, the cable is then moved via displacement means into a new position for the bulbing process to be repeated.

It is an object of the present invention to overcome or ameliorate at least one of the disadvantages of the prior art, or to provide a useful alternative.

It is an object of the present invention, at least in a preferred form, to provide a cable bulbing machine which does not require the use of cable displacement means for forming multiple bulbs along the length of a cable bolt.

SUMMARY OF THE INVENTION

According to a first aspect of the invention there is provided a cable bulbing apparatus comprising:

a frame;

securing means for holding at least a portion of a cable bolt with respect to said frame; and a bulbing assembly releasably engagable with said cable bolt, said assembly being movable relative to said frame to enable one or more bulbs to be formed along said cable bolt length.

In one form, the bulbing assembly is slidably mounted to the frame.

Preferably, the bulbing assembly includes:

a base;

a first clamp set and second clamp set mounted to the base for releasable clamping engagement with the cable bolt wherein relative movement of the clamp sets forms a bulb in the cable bolt.

In one form, the first and second clamp sets each include a pair of hydraulically operated mutually opposed jaws for clamping the cable bolt.

In one form, the first clamp set is fixedly mounted to the base and the second clamp set is movably mounted to the base.

The bulbing assembly may include an actuator for providing the relative movement between the first and second clamp sets, the actuator being fixedly mounted to the base and in moving engagement with the second clamping means.

In particular embodiments, the actuator is preferably hydraulically or electrically powered.

In one form, the securing means is a cable bolt locking clamp.

In one form, the frame includes a pair of parallel racks.

The bulbing assembly may include a set of pinions in gearing engagement with the parallel racks for enabling the bulbing assembly to move along the cable bolt and form multiple bulbs.

In a particular embodiment, the set of pinions includes a pair of driven front pinions and a complementary pair of rear idler pinions.

In one form, the apparatus includes one or more proximity sensors for measuring the radial displacement of the bulb formed in the cable bolt. This radial displacement may also be set by control of the maximum oil pressure being applied to the actuator or by a timer controlling the length of time that oil pressure is applied to the actuator.

In one form, the apparatus includes an encoder for controlling the movement of the bulbing assembly along the cable.

According to a second aspect of the invention there is provided a method for forming bulbs in a cable bolt, the method comprising the steps of:

securing a cable bolt relative to a frame;

engaging a bulbing assembly at a first location on said cable bolt;

forming a bulb in said cable bolt at said first location;

releasing said bulbing assembly from said first location and repositioning said bulbing assembly to engage a second location along said cable bolt; and forming a second bulb in said cable bolt at said second location.

In one form, the bulbing assembly is slidably mounted to the frame to allow the assembly to move from the first location to the second location on the cable bolt.

The bulbing assembly may include:

a base; and a first clamp set and second clamp set mounted to the base wherein the cable bolt is clamped between the first and second clamp set and relative movement of the clamps sets towards one another displaces the strands in the cable bolt to form a bulb.

In one form, the method further comprises the steps of:

the cable bolt being released from the first and second clamp;

the first and second clamps being engaged adjacent the second location on the cable bolt; and the first and second clamps being moved towards one another to form a second bulb at the second location of the cable bolt.

In one form, one or more proximity sensors send a signal to stop the bulbing process when the strands of the cable bolt reach a desired radial displacement.

In a particular arrangement, the bulbing assembly disengages the cable bolt after the first bulb is formed and moves along the cable until an encoder sends a signal to stop at the second bulbing location and the bulbing process is repeated.

The cable bolt is may be supplied to the bulbing assembly by a cable reel or a pick and place style system.

In one form, the cable is removed from the bulbing assembly by pick and place style system.

BRIEF DESCRIPTION OF THE DRAWINGS

A preferred embodiment of the invention will now be described, by way of example only, with reference to the accompanying drawings in which.

DETAILED DESCRIPTION OF THE INVENTION

Figure 1:
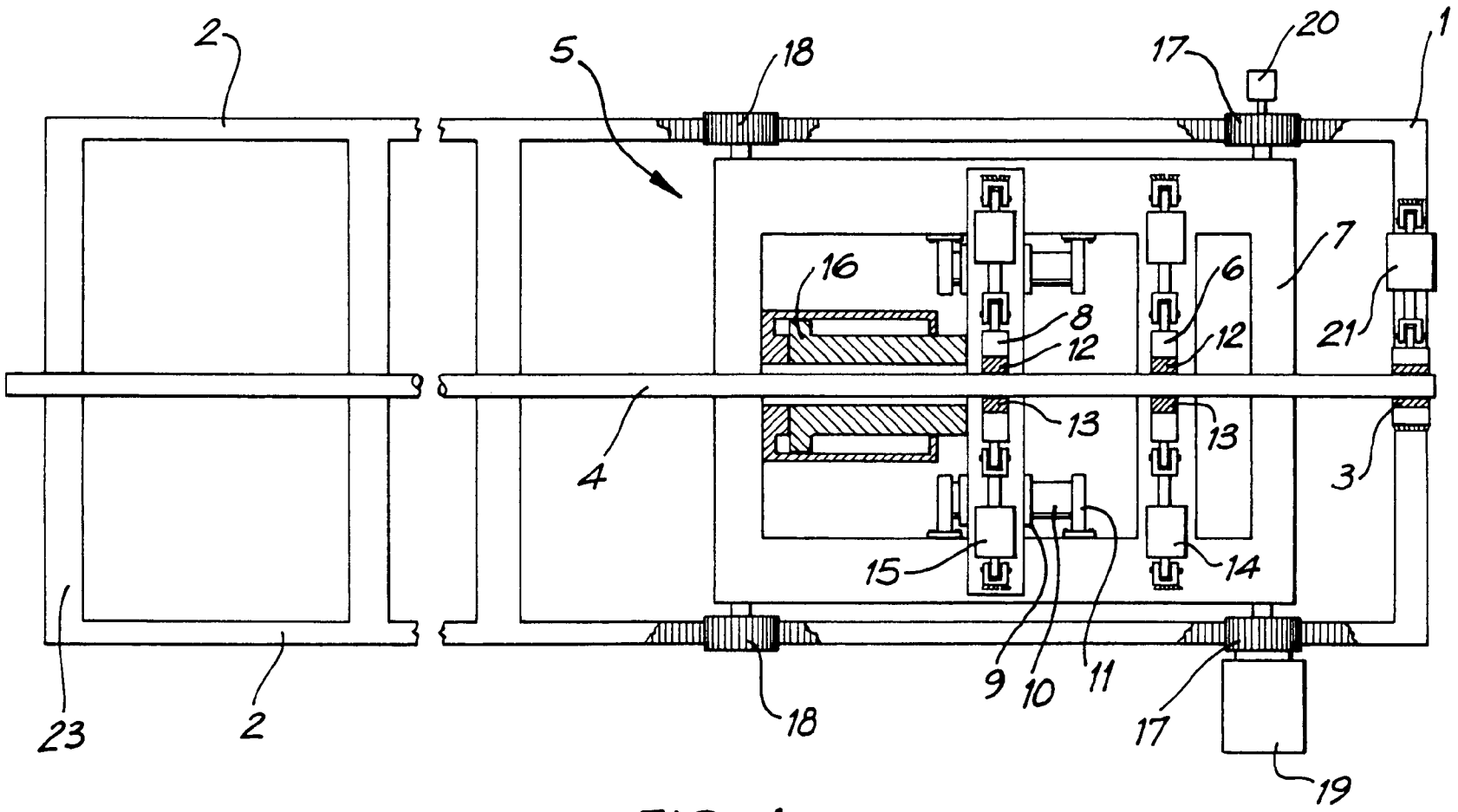
FIG. 1 is a plan view of a cable bulbing machine in accordance with the present invention, showing a cable bolt prior to bulbing.

Referring to the accompanying drawings, the cable bulbing apparatus includes a frame 1 having a pair of parallel racks 2. A securing means in the form of a cable bolt locking clamp 3 is mounted to one end of the frame for holding at least a portion of a cable bolt 4 in place during the bulbing process. The cable bolt locking clamp may also be utilised to crimp fittings such as "fish hooks" or steel sleeves on to the end of the cable bolt.

The apparatus also includes a bulbing assembly 5 having a first clamp set 6 fixedly mounted to a base 7 and a second clamp set 8 movably mounted to the base. The second clamp set 8 is supported by a sliding bush and shaft arrangement 9, 10 and 11.

Each clamp set includes a pair of hydraulically operated mutually opposed jaws 12 and 13 which are releasably engagable with the cable bolt 4. However, the invention is not limited to this form of clamping arrangement. Those skilled in the art will recognise that other clamping systems may be utilised to grip the tendon.

In the preferred embodiment, double acting hydraulic cylinders 14 and 15 are used to activate the first and second clamp sets 6 and 8 to clamp the cable bolt 4 therebetween. However, the double acting hydraulic cylinders 14 and 15 could be substituted by single double acting cylinders which activate the first and second clamp sets 6 and 8 to clamp the cable bolt 4 therebetween.

The bulbing assembly 5 includes an actuator in the form of a hydraulic piston 16 with one end fixedly mounted to the base 7 and the other end movably mounted to the second clamp set 8. The piston 16 provides movement of the second clamp set 8 towards the first clamp set 6 during the bulbing process. In an alternative embodiment, the single actuator is substituted by two actuators located either side of the cable bolt, each actuator having one end fixedly mounted to the base 7 and the other end movably mounted to the second clamp set 8.

It will be appreciated by those skilled in the art that other power sources such as electricity may be utilised to power the actuator/s.

The bulbing assembly 5 includes a set of driven front pinions 17 and a complementary pair of rear idler pinions 18 in gearing engagement with the parallel racks 2 for enabling the bulbing assembly 5 to move with respect to the cable bolt 4. The front pinions 17 are preferably driven by a reversible, variable speed, hydraulic motor with a built-in brake 19. A reversible, variable speed, electric motor with a brake could also be used for this purpose.

It will be appreciated by those skilled in the art that the bulbing assembly 5 is not limited to being slidably mounted to the frame 1. Alternatively, the bulbing assembly could be slidably mounted to a ceiling rail or the like which runs parallel to the cable bolt.

The cable bulbing apparatus includes one or more proximity sensors (not shown) for measuring the radial displacement of the bulb formed in the cable bolt 4. The apparatus also includes an encoder 20 for controlling the movement of the pinions 17 along the racks 2.

In use, the cable bolt 4 is laid across the length of the frame 1 with one end secured in the cable bolt locking clamp 3 and the remainder running between the jaws 12 and 13 of the first and second clamp sets 6 and 8. In the preferred embodiment, the cable bolt locking clamp is activated by a single double acting hydraulic cylinder 21.

Oil pressure is then applied to the double acting hydraulic cylinders 14 and 15 to respectively clamp the cable bolt 4 between the jaws of the first and second clamp sets, as shown in FIG. 1.

Figure 2:
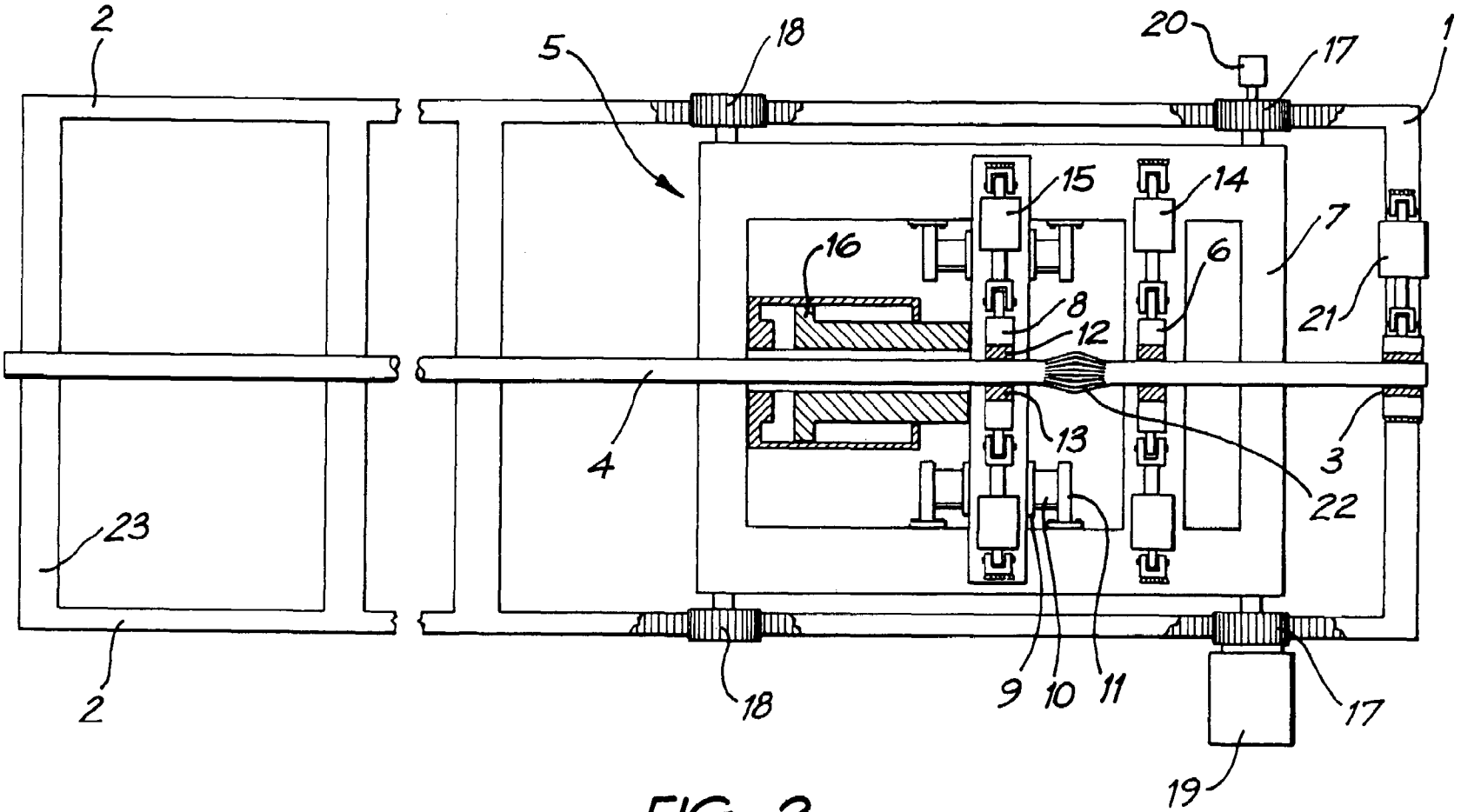
FIG. 2 is a plan view of the cable bulbing machine, showing a cable bolt after a bulb has been formed.

The hydraulic piston 16 is then activated to move the second clamp set 8 towards the first clamp set 6 forming a bulb in the cable bolt 4, as shown in FIG. 2. Radial displacement of the cable bolt 4 is preferably controlled by a PLC control system using one or more proximity sensors to limit the radial displacement of the bulb 22. This is achieved by controlling the oil pressure on the underside of the hydraulic piston 16 to stop the movement of the second clamp set 8 towards the first clamp set 6 when a desired displacement has been reached.

Once the first bulb 22 is formed, oil pressure is applied to the hydraulic cylinders 14 and 15 to release the cable bolt 4 from the jaws of the first and second clamp set 6 and 8. Oil pressure is then applied to the topside of the hydraulic piston 16 which in turn moves the second clamp set 8 back to its starting position, as shown in FIG. 1.

If multiple bulbs are required, the reversible, variable speed, hydraulic motor with a built-in brake 19 is activated to drive the pinions 17 along the racks 2. This allows the bulbing assembly to move along the frame 1 to align the first and second clamp sets 6 and 8 with the next desired bulbing location on the cable bolt 4. The encoder 20 senses when the bulbing assembly 5 reaches the desired displacement from the most recently formed bulb 22 and sends a signal via the PLC control unit to the reversible, variable speed, hydraulic motor with a built-in brake 19 to stop rotation of the pinions 17. The bulbing process can then be repeated. This process is continues until the desired number of bulbs are formed in the cable bolt.

It will be appreciated by those skilled in the art that various methods can be used for supplying cable to the apparatus. These include continuously feeding the cable from a reel or supplying cut lengths of cable. Cut lengths of cable can be fed to the apparatus manually, via a magazine, or via a pick and place style system.

When creating multiple bulbs in a cut length of cable bolt, at the end of the bulbing process, the bulbing assembly 5 is driven to the far end 23 of the frame 1 by the reversible, variable speed, hydraulic motor with a built-in brake 19. The bulbed cable bolt 4 is then removed from the cable bulbing apparatus either manually or via an automatic means such as a pick and place style system.

A subsequent cut length of cable bolt can then be supplied to the cable bulbing apparatus and the above process repeated. Supply of the cable bolt can either be performed manually or by some form of automation controlled by the PLC control system.

The present invention has been described herein by way of example only. Ordinary workers in this field will readily recognise many variations and modifications which do not depart from the spirit and scope of the broad inventive concept.

The invention claimed is:

1. A cable bulbing apparatus comprising:

a frame;

securing means for holding at least a portion of a cable bolt with respect to said frame; and a bulbing assembly releasably engagable with said cable bolt and operative to form a bulb in a portion of the cable to which it is engaged, said assembly being movable relative to said frame to allow repositioning of said bulbing assembly along at least part of the length of said cable bolt to enable a plurality of spaced apart one or more bulbs to be formed along said cable bolt length, wherein said bulbing assembly comprises a base and a clamping system.

2. An apparatus according to claim 1 wherein said bulbing assembly is slidably mounted to said frame.

3. An apparatus according claim 1 wherein said clamping system includes:

a first clamp set and second clamp set mounted to said base for releasable clamping engagement with said cable bolt wherein relative movement of said clamp sets forms a bulb in said cable bolt.

4. An apparatus according to claim 3 wherein said first and second clamp sets each include a pair of hydraulically operated mutually opposed jaws for clamping said cable bolt.

5. An apparatus according to claim 3 wherein said first clamp set is fixedly mounted to said base and said second clamp set is movably mounted to said base.

6. An apparatus according to claim 3 wherein said bulbing assembly includes an actuator for providing said relative movement between said first and second clamp sets, said actuator being fixedly mounted to said base and in moving engagement with said second clamping means.

7. An apparatus according to claim 6 wherein said actuator is hydraulically powered.

8. An apparatus according to claim 6 wherein said actuator is electrically powered.

9. An apparatus according to claim 1 wherein said securing means is a cable bolt locking clamp.

10. An apparatus according to claim 1 wherein said frame includes a pair of parallel racks.

11. An apparatus according to claim 1 including one or more proximity sensors for measuring the radial displacement of the bulb formed in the cable bolt.

12. An apparatus according to claim 1 including an encoder for controlling the movement of said bulbing assembly along said cable.

13. A method for forming bulbs in a cable bolt, said method comprising the steps of:

securing a cable bolt relative to a frame;

engaging a bulbing assembly at a first location on said cable bolt, wherein said bulbing assembly comprises a base and a clamping system;

forming a bulb in said cable at said first location;

releasing said bulbing assembly from said first location and repositioning said bulbing assembly to engage a second location along said cable bolt; and forming a second bulb in said cable at said second location.

14. A method according to claim 13 wherein said bulbing assembly is slidably mounted to said frame to allow said assembly to move from said first location to said second location on said cable bolt.

15. A method according claim 13 wherein said clamping system includes:

a first clamp set and second clamp set mounted to said base wherein said cable bolt is clamped between said first and second clamp set and relative movement of said clamps sets towards one another displaces the strands in said cable bolt to form a bulb.

16. A method according to claim 15 including the steps of:

said cable bolt being released from said first and second clamp;

said first and second clamps being engaged adjacent said second location on said cable bolt; and said first and second clamps being moved towards one another to form a second bulb at said second location of said cable bolt.

17. A method according to claim 13 wherein one or more proximity sensors sends a signal to stop the bulbing process when the strands of the cable bolt reach a desired radial displacement.

18. A method according to claim 13 wherein said bulbing assembly disengages said cable bolt after said first bulb is formed and moves along said cable until an encoder sends a signal to stop at said second bulbing location and the bulbing process is repeated.

19. A method according to claim 13 wherein said cable bolt is supplied to said bulbing assembly by a cable reel.

20. A method according to claim 13 wherein said cable is supplied to said bulbing assembly by a pick and place style system.

21. A method according to claim 13 wherein said cable is removed from said bulbing assembly by pick and place style system.

22. A cable bulbing apparatus comprising:

a frame;

securing means for holding at least a portion of a cable bolt with respect to said frame; and a bulbing assembly releasably engagable with said cable bolt and operative to form a bulb in a portion of the cable to which it is engaged, said assembly being movable relative to said frame to allow repositioning of said bulbing assembly along at least part of the length of said cable bolt to enable a plurality of spaced apart one or more bulbs to be formed along said cable bolt length, wherein said frame includes a pair of parallel racks, and wherein said bulbing assembly includes a set of pinions in gearing engagement with said parallel racks for enabling said bulbing assembly to move along said cable bolt and form multiple bulbs.

23. The apparatus according to claim 22, wherein said set of pinions includes a pair of driven front pinions and a complementary pair of rear idler pinions.

* * * * *